US009131827B2

(12) United States Patent
Usta Yogun

(10) Patent No.: US 9,131,827 B2
(45) Date of Patent: Sep. 15, 2015

(54) DISHWASHER

(76) Inventor: Halime Usta Yogun, Istanbul (TR)

( * ) Notice: Subject to any disclaimer, the term of this patent is extended or adjusted under 35 U.S.C. 154(b) by 655 days.

(21) Appl. No.: 12/811,360

(22) PCT Filed: Dec. 12, 2008

(86) PCT No.: PCT/EP2008/066957

§ 371 (c)(1),
(2), (4) Date: Jun. 30, 2010

(87) PCT Pub. No.: WO2009/083391

PCT Pub. Date: Jul. 9, 2009

(65) Prior Publication Data

US 2010/0282280 A1 Nov. 11, 2010

(30) Foreign Application Priority Data

Dec. 31, 2007 (TR) ..... a 2007 09257

(51) Int. Cl.
*A47L 15/42* (2006.01)

(52) U.S. Cl.
CPC ..... *A47L 15/4276* (2013.01); *A47L 15/4246* (2013.01); *A47L 15/4295* (2013.01)

(58) Field of Classification Search
USPC ..... 134/56 D
See application file for complete search history.

(56) References Cited

U.S. PATENT DOCUMENTS

| | | | | |
|---|---|---|---|---|
| 3,068,877 | A * | 12/1962 | Jacobs | 134/99.1 |
| 2003/0221709 | A1 | 12/2003 | Jung et al. | |
| 2007/0131259 | A1 * | 6/2007 | Classen | 134/56 D |

FOREIGN PATENT DOCUMENTS

| | | | |
|---|---|---|---|
| DE | 3921177 | A1 | 9/1991 |
| EP | 0239012 | A | 9/1987 |
| JP | 07079906 | A | 3/1995 |
| JP | 2003144372 | A | 5/2003 |
| WO | 2006082552 | A | 8/2006 |
| WO | WO 2006127478 | A1 * | 11/2006 |

* cited by examiner

*Primary Examiner* — Joseph L Perrin
*Assistant Examiner* — Levon J Shahinian
(74) *Attorney, Agent, or Firm* — Venjuris PC

(57) ABSTRACT

The present invention relates to a dishwasher (1) comprising a tub (2) wherein the items to be washed are emplaced, an odor detector (3) for measuring the odor level of the interior air (H-in) containing the gasses emanating from the dishes in the tub (2) that generate bad odor and a housing (4) wherein the odor detector (3) is disposed and the odor detector (3) effectively measures the interior air (H-in) in the housing (4) thereby performing an adaptive washing program depending on the detected odor level.

19 Claims, 1 Drawing Sheet

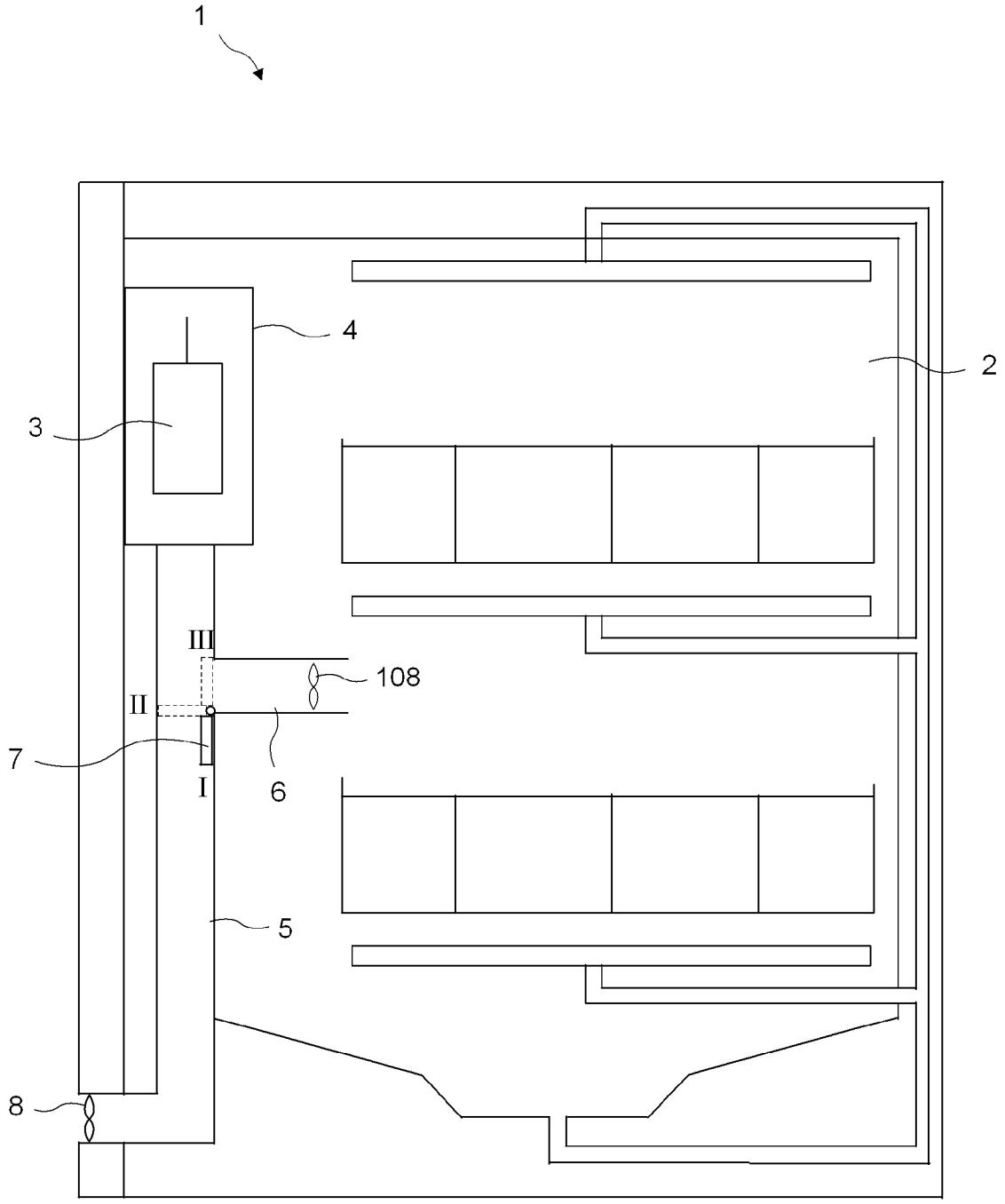
1
4
2
3
III
108
II
7
I
6
5
8

DISHWASHER

The present invention relates to a dishwasher wherein the level of odor emanating from the dishes kept waiting to be washed is detected.

When the pre-wash waiting period of the dishes in the dishwasher is long and when the dishwasher door is opened after said long waiting period, the bad odor dissipates to the environment. In case an odor detector is used to detect the bad odor in the dishwashers, the odor detector should be prevented from being affected by the wash water. Moreover, the environment with no odor should be taken as a reference for the initial position of the odor detector and sample air from the dishwasher interior air should be taken and delivered thereto so that the odor detector can take correct measurements.

The state of the art International patent application no WO2006082552 relates to a dishwasher and control method wherein the dishes kept waiting in the tub with the door closed are prevented from dissipating bad odor to the medium when the door is opened. An odor detector is used in the dishwasher and the odor detector is emplaced in a measuring chamber suitable for taking a sample of air in the tub sufficient for measurement. The odor level of air in the measuring chamber being detected can still stay in the measuring chamber after the odor in the tub is eliminated and results in the odor detector to making an incorrect detection of the present situation.

The aim of the present invention is the realization of a dishwasher wherein an odor detector is used for detecting the odor emanating from the dishes and the odor detector is enabled to take correct measurements.

The dishwasher realized in order to attain the aim of the present invention is explicated in the claims.

In the dishwasher, an odor detector is used to measure the odor level of the interior air containing the gasses emanating from the dishes waiting in the tub to be washed and producing an odor and the odor detector is emplaced in the tub preferably in a housing preferably mounted on the inner side of the door.

The dishwasher of the present invention comprises a cleaning channel for resetting the odor detector before taking measurements. One end of the cleaning channel opens outside of the tub and the other end is connected to the housing, delivering the clean exterior air outside the tub into the odor detector in the housing.

In an embodiment of the present invention, the dishwasher comprises a sample channel, with one end fastened to the housing, the other end extending into the tub, for example between the two baskets, for taking sample air of the interior air containing gasses emanating from the dishes emplaced in the tub to be washed and producing an odor for delivering to the odor detector.

In another embodiment of the present invention, the dishwasher comprises a shutter that functions in three modes, in the first mode namely the reset mode, directs the exterior air into the housing, in the second mode namely the measuring mode directs the interior air into the housing, and in the third mode namely the washing mode, prevents water from entering into the housing.

In another embodiment of the present invention, in the dishwasher, fans are utilized for delivering the outside air quickly to the odor detector in order to make an effective reset and/or for delivering the interior air quickly to the odor detector and to effectively detect the odor level of the interior air.

A dishwasher realized in order to attain the aim of the present invention is illustrated in the attached figures, where:

FIG. 1—is the schematic view of a dishwasher.

The elements illustrated in the figures are numbered as follows:

1. Dishwasher
2. Tub
3. Odor detector
4. Housing
5. Cleaning channel
6. Sample channel
7. Shutter
8. 108. Fan The dishwasher (1) comprises a washing tub (2) wherein the items to be washed are emplaced, a door for accessing inside the tub (2), one or more baskets wherein the items to be washed are emplaced, an odor detector (3) for measuring the odor level of the interior air (H-in) containing the gasses emanating from the dishes in the tub (2) that generate bad odor and a housing (4) wherein the odor detector (3) is emplaced.

The dishwasher (1) of the present invention comprises a cleaning channel (5), with one end opening outside of the tub (2), the other end connected to the housing (4) that delivers the clean exterior air (H-out) from outside the tub (2) to the odor detector (3) in the housing (4), expelling out the interior air (H-in) left in the housing (4), filling in exterior air (H-out) instead, and the odor detector (3) resetting with the exterior air (H-out) filled in the housing (4) as reference.

In the dishwasher (1), the odor level of the interior air (H-in) is measured by the odor detector (3) before the start of the washing process. The odor detector (3) has to be reset previously in order to take measurements. To this end, before measuring the odor level of the interior air (H-in), the exterior air (H-out) is delivered from the cleaning channel (5) into the housing (4), enabling the odor detector (3) to accept as reference (for example zero) the odor level of the exterior air (H-out) and afterwards to correctly measure the odor level of the interior air (H-in). After the odor detector (3) is brought to reset mode, the interior air (H-in) is taken into the housing (4) and the odor level of the interior air (H-in) is measured by the odor detector (3). After the odor level of the interior air (H-in) is measured, the washing process is started, implementing an adaptive washing program according to the detected odor level, adjusting the parameters such as duration and temperature of the washing program depending on the detected odor level.

In an embodiment of the present invention, the dishwasher (1) comprises a sample channel (6), with one end fastened to the housing (4), the other end extending into the tub (2), preferably between the two baskets, for taking an air sample of the interior air (H-in) containing gasses emanating from the dishes emplaced in the tub (2) to be washed and producing an odor for delivering to the housing (4) thereby enabling the odor detector (3) to detect the odor level of the interior air (H-in).

In another embodiment of the present invention, the dishwasher (1) comprises a shutter (7) disposed at the point wherein the cleaning channel (5) and the sample channel (6) are connected to each other, which functions at three modes (I, II, IIII).

The shutter (7), at the first mode (I), wherein the odor detector (3) is reset, opens the cleaning channel (5) prior to the washing process and allows the exterior air (H-out) to reach the odor detector (3) in the housing (4).

The shutter (7), at the second mode (II), wherein the odor detector (3) takes measurements, closes the cleaning channel (5), obstructing the path of the exterior air (H-out), allowing only the interior air (H-in) to reach the odor detector (3) in the housing (4).

The shutter (7), closes the sample channel (6) in the third mode (III) after the reset operation at the first mode (I) and measuring operation at the second mode (II) are finalized, preventing the water circulating in the tub (2) from reaching the odor detector (3) in the housing (4) through the sample channel (6) when the washing process is performed.

In another embodiment of the present invention, the dishwasher (1) comprises an exterior air fan (8), disposed in the cleaning channel (5) for delivering the exterior air (H-out) quickly to the odor detector (3) enabling an effective resetting.

In another embodiment of the present invention, the dishwasher (1) comprises an interior air fan (108), disposed in the sample channel (6) for delivering the interior air (H-in) quickly to the odor detector (3) thereby enabling the odor detector (3) to effectively detect the odor level of the interior air (H-in).

In the dishwasher (1) of the present invention, the water circulating in the tub (2) during washing is prevented from reaching the odor detector (3), the interior air (H-in) containing gasses emanating from the dishes waiting in the tub (2) to be washed and bad odor is correctly measured by the odor detector (3) which is reset with the exterior air (H-out) delivered through the cleaning channel (5) and an adaptive washing program is performed depending on the detected odor level.

The invention claimed is:

1. A dishwasher (1) comprising a tub (2), an odor detector (3) for measuring an odor level of interior air (H-in) containing gasses emanating from dishes in the tub (2) that generate bad odor and a housing (4) wherein the odor detector (3) is emplaced and characterized by a cleaning channel (5), with one end opening outside of the dishwasher (1) to clean exterior air (H-out), an other end directly connected to the housing (4), for delivering clean exterior air (H-out) from outside the tub (2) to the odor detector (3) in the housing (4), expelling out interior air (H-in) left in the housing (4), filling in exterior air (H-out) instead.

2. The dishwasher (1) as in claim 1, characterized by the odor detector (3) resetting with exterior air (H-out) filled in the housing (4) by means of the cleaning channel (5).

3. The dishwasher (1) as in claim 2, characterized by a sample channel (6), having one end of the sample channel coupled to the housing (4), and another end of the sample channel extending into the tub (2), for taking an air sample of the interior air (H-in) and delivering to the housing (4).

4. The dishwasher (1) as in claim 3, characterized by a shutter (7) disposed where the cleaning channel (5) and the sample channel (6) are connected to each other, that opens the cleaning channel (5) prior to a washing process and allows the exterior air (H-out) to reach the odor detector (3) in the housing (4) at a first mode (I), wherein the odor detector (3) is reset.

5. The dishwasher (1) as in claim 4, characterized by the shutter (7) that closes the cleaning channel (5), obstructing the exterior air (H-out), allowing only the interior air (H-in) to reach the odor detector (3) in the housing (4) at a second mode (II), wherein the odor detector (3) takes measurements.

6. The dishwasher (1) as in claim 5, characterized by the shutter (7) that closes the sample channel (6) in a third mode (III) when a washing process is performed, preventing water circulation in the tub (2) from reaching the odor detector (3) in the housing (4) through the sample channel (6) after the reset and measuring operations at the first mode (I) and the second mode (II) are finalized.

7. The dishwasher (1) as in claim 6, characterized by an exterior air fan (8) disposed in the cleaning channel (5) for delivering the exterior air (H-out) quickly to the odor detector (3).

8. The dishwasher (1) as in claim 7, characterized by an interior air fan (108) disposed in the sample channel (6) for delivering the interior air (H-in) quickly to the odor detector (3).

9. The dishwasher (1) as in claim 8, characterized by performing a washing process after the odor level of the interior air (H-in) is measured and implementing an adaptive washing program depending on the detected odor level.

10. The dishwasher (1) as in claim 2, characterized by a shutter (7) disposed where the cleaning channel (5) and a sample channel (6) are connected to each other, that opens the cleaning channel (5) prior to a washing process and allows the exterior air (H-out) to reach the odor detector (3) in the housing (4) at a first mode (I), wherein the odor detector (3) is reset.

11. The dishwasher (1) as in claim 1, having one end of the sample channel coupled to the housing (4), and another end of the sample channel extending into the tub (2), for taking an air sample of the interior air (H-in) and delivering to the housing (4).

12. The dishwasher (1) as in claim 11, characterized by a shutter (7) disposed where the cleaning channel (5) and the sample channel (6) are connected to each other, that opens the cleaning channel (5) prior to a washing process and allows the exterior air (H-out) to reach the odor detector (3) in the housing (4) at a first mode (I), wherein the odor detector (3) is reset.

13. The dishwasher (1) as in claim 1, characterized by a shutter (7) disposed where the cleaning channel (5) and a sample channel (6) are connected to each other, that opens the cleaning channel (5) prior to a washing process and allows the exterior air (H-out) to reach the odor detector (3) in the housing (4) at a first mode (I), wherein the odor detector (3) is reset.

14. The dishwasher (1) as in claim 13, characterized by the shutter (7) that closes the cleaning channel (5), obstructing the exterior air (H-out), allowing only the interior air (H-in) to reach the odor detector (3) in the housing (4) at a second mode (II), wherein the odor detector (3) takes measurements.

15. The dishwasher (1) as in claim 13, characterized by the shutter (7) that closes the sample channel (6) in a third mode (III) when a washing process is performed, preventing water circulation in the tub (2) from reaching the odor detector (3) in the housing (4) through the sample channel (6) after the reset and measurements at the first mode (I) and a second mode (II) are finalized.

16. The dishwasher (1) as in claim 1, characterized by an exterior air fan (8) disposed in the cleaning channel (5) and coupled to the exterior air (H-out) outside of the dishwasher for delivering the exterior air (H-out) quickly to the odor detector (3).

17. The dishwasher (1) as in claim 1, characterized by an interior air fan (108) disposed in a sample channel (6) for delivering the interior air (H-in) quickly to the odor detector (3).

18. The dishwasher (1) as in claim 1, characterized by performing a washing process after the odor level of the interior air (H-in) is measured and implementing an adaptive washing program depending on the detected odor level.

19. A dishwasher (1) comprising a tub (2), an odor detector (3) for measuring an odor level of interior air (H-in) containing gasses emanating from dishes in the tub (2) that generate bad odor and a housing (4) wherein the odor detector (3) is emplaced and characterized by a cleaning channel (5) within the tub, with one end opening outside of the dishwasher (1) directly to clean exterior air (H-out), an other end directly connected to the housing (4), for delivering clean exterior air (H-out) from outside the dishwasher (1) to the odor detector (3) in the housing (4), expelling out interior air (H-in) left in the housing (4), filling in exterior air (H-out) instead.

* * * * *